United States Patent [19]

Frey

[11] Patent Number: 4,550,531

[45] Date of Patent: Nov. 5, 1985

[54] GRINDING BOX

[76] Inventor: William L. Frey, 303 Ivory Avenue, Pittsburgh, Pa. 15214

[21] Appl. No.: 563,214

[22] Filed: Dec. 19, 1983

[51] Int. Cl.[4] ..... B24B 7/00

[52] U.S. Cl. ..... 51/125; 51/128; 51/125.5; 51/217 R

[58] Field of Search ..... 51/125, 125.5, 128, 51/216 R, 217 R, 229, 121, 268; 269/47, 52

[56] References Cited

U.S. PATENT DOCUMENTS

| | | | |
|---|---|---|---|
| D. 163,490 | 5/1951 | Springman | 51/125 X |
| 869,068 | 10/1907 | Deputy | 51/125.5 |
| 1,013,115 | 1/1912 | Bird | 51/125.5 |
| 1,956,686 | 5/1934 | Kane | 51/125.5 |
| 2,645,886 | 7/1953 | Peterson | 51/128 X |
| 2,829,472 | 4/1958 | Salzer | 51/125 |
| 3,577,682 | 5/1971 | Kulischenko | 51/413 |
| 3,694,967 | 10/1972 | Stiepler | 51/128 X |
| 3,742,652 | 7/1973 | Enders | 51/128 X |
| 3,936,981 | 2/1976 | White | 51/125 |
| 4,295,640 | 10/1981 | Merrell | 269/47 |

*Primary Examiner*—Frederick R. Schmidt
*Assistant Examiner*—Debra S. Meislin
*Attorney, Agent, or Firm*—Webb, Burden, Robinson & Webb

[57] ABSTRACT

A grinding box for reducing the size of bolt heads and nuts from one size to another, preferably from metric standard sizing to American standard sizing, is disclosed. The grinding box includes a housing with a base, sidewalls, and a cover; an abrading mechanism, such as a power driven abrading wheel, positioned within the housing and beneath the cover; an opening through the cover providing access to the abrading mechanism; and a device for placing bolt heads and nuts in contact with the abrading mechanism such that their faces are abraded and the bolt heads and nuts are reduced to a predetermined smaller size.

8 Claims, 2 Drawing Figures

GRINDING BOX

DESCRIPTION

Technical Field

This invention relates to grinding boxes and, more particularly, to a grinding box which enables bolt heads and nuts to be reduced from one size to another, such as from a metric size to an American standard size.

Background Art

The United States has historically relied upon the inch and foot, rather than the meter, as the standard measure of length. Accordingly, various items, including bolt heads and nuts, have been sized in inches or fractions or multiples thereof. This is referred to as American standard sizing. Over the years, mechanics and the like have acquired tools which are specifically built to fit the different American standard sized bolt heads and nuts utilized in the trade.

Recently the United States has begun to convert to the metric system and articles are being manufactured and sold, such as automobiles or the like, which include bolts and nuts sized according to a variety of metric standards. Also, many foreign cars, which have metric bolts and nuts, are being imported and sold in the United States. For the most part, tools designed to fit bolt heads and nuts designed under the American standard sizing system will not fit or be usable in connection with metric sized bolt heads and nuts. While tools are available that are designed to specifically fit metric bolt heads and nuts, the purchase of an additional set of tools is a rather expensive undertaking for a mechanic who already owns a set of tools designed under American standard sizing. Furthermore, a mechanic must keep the American standard sized tools available to work on the previously existing American standard sized bolt heads and nuts. Accordingly, a mechanic may find it essential to maintain two complete sets of tools in order to be able to work with both metric and American bolts and nuts, all at considerable expense and trouble. In addition, plastic inserts which convert American sized tools to a metric size are not particularly useful.

Generally, metric sized bolt heads and nuts are slightly bigger than the closest sized American bolt heads and nuts. One solution to the problem of maintaining two complete sets of tools would be to grind a metric bolt head or nut down to an appropriate American sizing and merely utilize the American sized tools. Conceptually, this is an attractive solution because it can be determined precisely, by reference to tables or by actual measurement with a micrometer, how much material must be removed from a metric nut to bring that nut in line with an appropriate American sizing.

Devices designed to abrade various workpieces are well known in the art. For example, U.S. Pat. No. 2,829,472 discloses an automatic diamond cutting and polishing device in which a diamond is brought into contact with a horizontally rotating abrading wheel by a diamond holding machine which precisely positions the diamond against the abrading wheel. U.S. Pat. No. 3,577,682 discloses a workpiece holder for an abrading apparatus useful in trimming resistors printed on a substate. U.S. Pat. Nos. 869,068 and 1,013,115 disclose razor sharpening devices which include an abrading disk positioned beneath and in contact with the blade of the razor for sharpening thereof. U.S. Pat. No. 3,742,652 discloses a drill sharpener which includes a body with a plurality of different sized openings which provide access to a rotatable grinding wheel located beneath the body. However, none of these devices are designed for or are capable of holding and precisely grinding bolt heads or nuts.

Accordingly, it is an object of the present invention to provide a device which can grind metric sized bolt heads and nuts down to an American standard sizing such that American sized tools may be used on such bolt heads and nuts.

It is a further object of the present invention to provide such a device in which the bolt heads and nuts can be ground down quickly, easily, consistently, and with no complicated measuring apparatus.

SUMMARY OF THE INVENTION

Therefore, I have invented a grinding box for reducing the size of bolt heads and nuts from one size to another which includes a housing formed of a base, a sidewall and a cover. An abrading means, preferably a power driven abrading wheel, is positioned within the housing and beneath the cover and the cover includes an opening therethrough which provides access to the top surface of the abrading wheel. The grinding box also includes a means for placing bolt heads and nuts in contact with the abrading wheel such that their faces are abraded and reduced to a predetermined smaller size. The cover, preferably a flat, circular plate, includes one or more channels which extend outwardly from the opening, preferably radially, along the top surface of the cover. Each channel can receive the threaded portion of a particularly sized bolt and position the bolt head against the abrading wheel. By the action of the abrading wheel, the bolt head is reduced to a smaller size as determined by the spacing between the bottom of the channel and the top surface of the abrading wheel. The cover also includes one or more nut pilot shafts pivotally mounted to its top surface adjacent each channel. The pilot shaft receives and holds a nut thereon and when the pilot shaft is positioned within the channel, the nut may be brought into contact with the abrading wheel and reduced in size. The final size of the nut is, likewise, determined by the spacing between the bottom of the channel and the top surface of the abrading wheel.

Each pilot shaft may be provided with a nut clip to hold a nut more securely in place. The opening is formed preferably in the shape of a polygon and one channel extends outwardly from each face of the polygon-shaped opening. The grinding box may be provided with a plurality of channels and pilot shafts, each of a different size to accommodate different sized nuts and bolts. The relationship of each channel and pilot shaft with the abrading wheel may be predetermined such that bolt heads and nuts may be reduced from one standard size to another, e.g., from metric standard sizing to an American standard size.

The grinding box of the present invention can also be used to square up the corners of nuts and bolt heads that have become rounded. Also, the arrangement of the cover, the channels and the pilot shafts enables bolt heads and nuts to be held against the abrading wheel without burning the fingers of the operator.

DETAILED DESCRIPTION OF THE DRAWINGS

Figure 1:
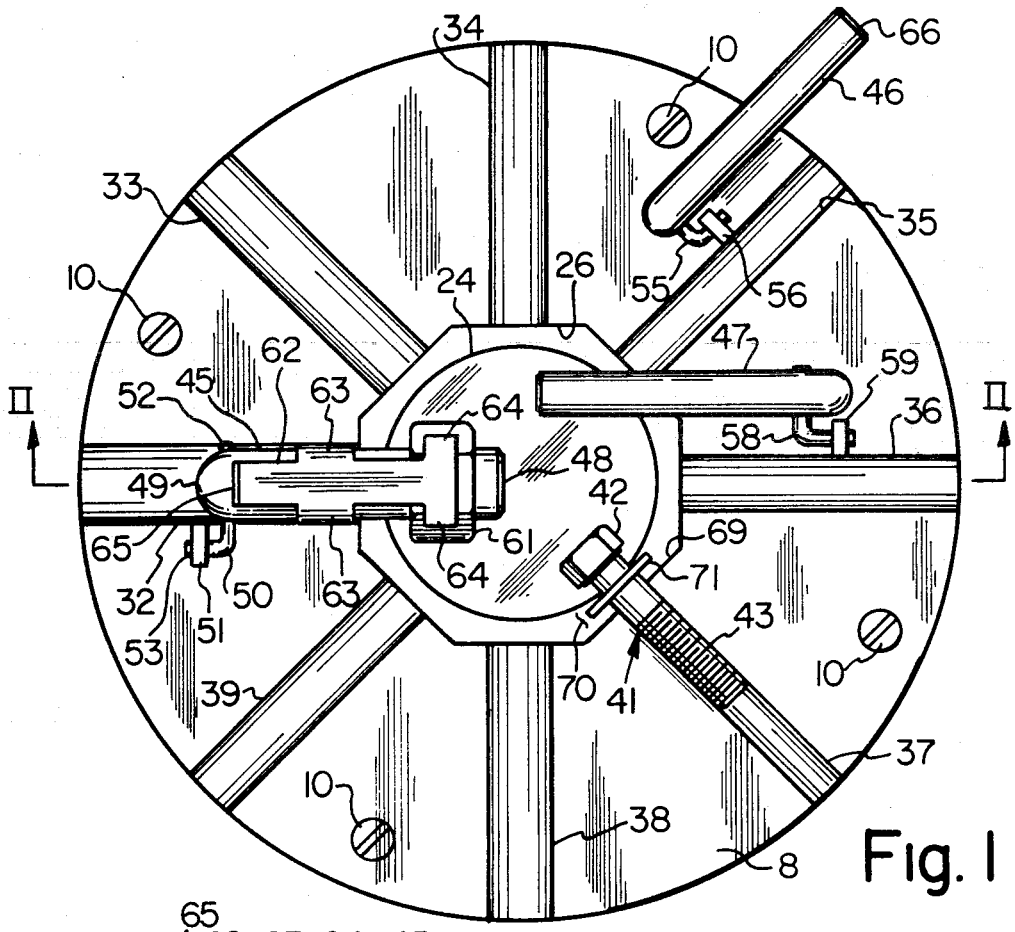
FIG. 1 is a top plan view of a grinding box formed in accordance with the present invention.
Figure 2:
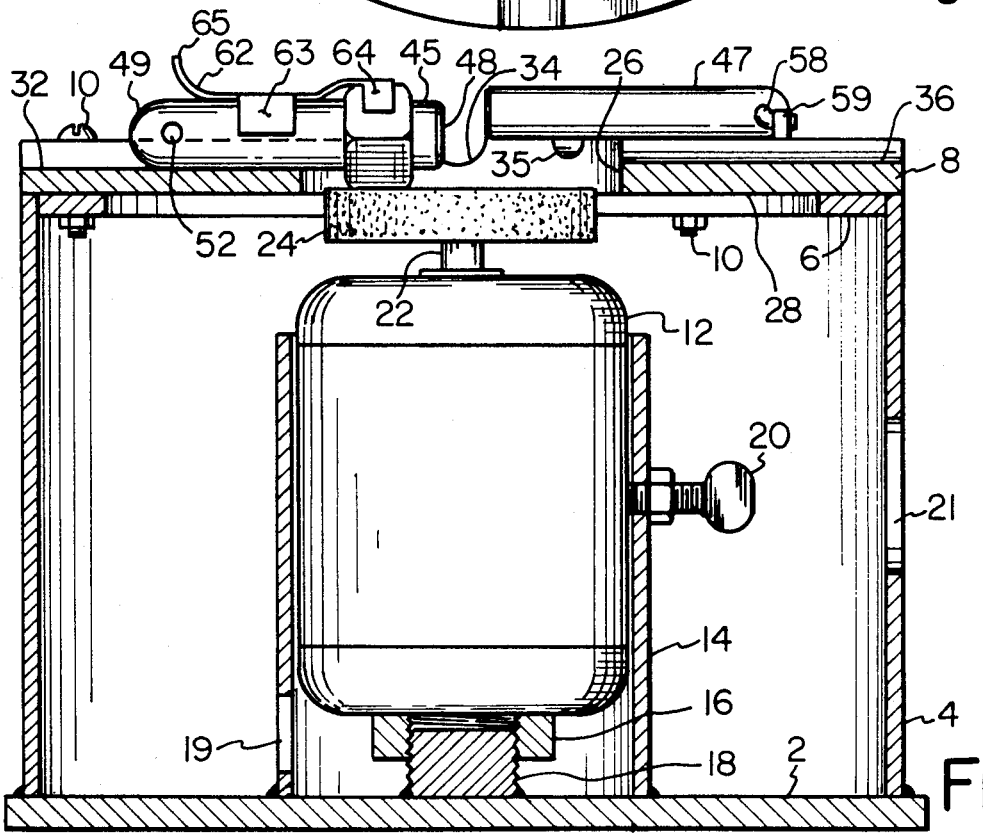
FIG. 2 is a sectional view of the grinding box shown in FIG. 1 taken alone line H—H.

One embodiment of a grinding box in accordance with the present invention is shown in FIGS. 1 and 2. The grinding box includes a base 2 and a sidewall 4 attached to the base 2 and extending upwardly therefrom adjacent the outer perimeter of the base 2. A support ridge 6 is attached to the inner surface of the sidewall 4 near its upper end and a horizontal cover 8 is attached to the support ridge 6 by means of a plurality of fasteners, such as securing bolts 10 or the like. The cover 8 extends across and covers the upper end of the sidewall 4 to form a box-like housing defined by the base 2, sidewall 4 and cover 8. Preferably, the base 2 and cover 8 are formed in the shape of flat, circular plates and the sidewall 4 extends therebetween to form a cylindrical structure. The sidewall 4 may be attached to the base 2 and the support ridge 6 may be attached to the sidewall 4 by welding or the like.

A motor 12, such as an electric motor, is disposed within the housing and held in a vertical orientation by a motor housing 14 which is mounted to the base 2 and surrounds the motor 12. A motor adjusting nut 16 is attached to the bottom of the motor 12 and a motor adjusting screw 18 is attached to the top of the base 2 within the motor housing 14. The motor adjusting nut 16 is threaded onto the motor adjusting screw 18 to thereby secure the motor 12 to the base 2 within the motor housing 14. The height of the motor 12 with respect to the base 2 may be varied by means of the threaded connection between the motor adjusting nut 16 and the motor adjusting screw 18. The motor housing 14 may include opening or port 19 therethrough adjacent the motor adjusting nut 16 to provide access for a wrench or the like to turn the motor adjusting nut 16. The motor 12 is then locked into position within the motor housing 14 by a lock screw 20 which passes through the motor housing 14 and contacts the motor 12. The sidewall 4 may include opening or port 21 therethrough adjacent the lock screw 20 to provide access for a wrench or the like to turn the lock screw 20. The inner width of the motor housing 14 is preferably only slightly larger than the outer width of the motor 12 to provide a stable support for the motor 12. The shaft 22 of the motor 12 is oriented toward the cover 8 of the grinding box and has a horizontally rotating abrading wheel 24 mounted thereto. The motor 12 is adjusted vertically in order to fix the initial position of the abrading wheel 24 and to later adjust for wear to the abrading wheel 24.

The motor 12 is advantageously located in a central location with respect to the base 2 and sidewall 4 and preferably the vertical center line of the motor 12 passing through shaft 22 is in line with a perpendicular line passing through the center of the base 2. Typically, the motor 12 will have a circular cross section and the motor housing 14 will be cylindrically shaped. The motor housing 14 and motor adjusting screw 18 may be attached to the base 2 and the motor adjusting nut 16 may be attached to the motor 12 by welding or the like.

The cover 8 has an opening 26 therethrough which is adjacent to and provides access to the top surface of the abrading wheel 24. Opening 26 should be larger in diameter than the abrading wheel 24 and, rather than being circular, should be formed in the shape of a polygon. In the embodiment shown in the Figures, opening 26 is formed in the shape of a regular octagon. The abrading wheel 24 may extend upwardly beyond the bottom surface 28 of the cover 8 and into opening 26, as shown, or may be located entirely below the cover 8.

The cover 8 includes one or more radially extending channels which open upwardly on the top surface 30 of the cover 8. The embodiment of the grinding box shown in the Figures includes eight channels, namely, channels 32, 33, 34, 35, 36, 37, 38, and 39. The channels extend from the interior of the cover 8 at the opening 26 to the outside edge of the cover 8. The channels are preferably of semi-circular cross-section and are adapted to receive the threaded portion of a bolt laid therein. Each channel is advantageously of a depth different from the other channels in order that the grinding box may accommodate bolts of varying diameters. Since the channels extend to the outside edge of the cover 8, a bolt which has a threaded portion longer than the channel may be laid therein with the bolt extending beyond the outside edge of the cover 8.

A standard bolt 41 with a hex shaped head 42 is shown in FIG. 1 located in channel 37. The bolt 41 is arranged such that the head 42 is positioned within the opening 26, one face of the head 42 is placed against the abrading wheel 24, and the threaded portion 43 is placed in channel 37. Assuming the head 42 is of sufficient size, the threaded portion 43 of the bolt 41 will initially not lay flat within channel 37 but will angle upward toward the opening 26. If the abrading wheel 24 is rotated, via the action of the motor 12, and if force is applied downwardly on the bolt 14, the face of the head 42 adjacent the abrading wheel 24 will be abraded away until the length of the threaded portion 43 lays flat within channel 37. This process can be repeated for each surface of the head 42 of the bolt 41.

It can be seen that the final size of the bolt head is determined by the distance between the bottom of each channel and the top of the abrading wheel 24. By providing a channel of a particular depth in relationship to a particular vertical position of the abrading wheel 24, an amount of material will be removed from a bolt head until a predetermined final size is reached. Accordingly, the head of a bolt can be ground down to any smaller size desired. Also, an old bolt head with rounded corners can be ground down to square up the corners.

The cover 8 also includes one or more nut pilot shafts pivotally mounted to the cover 8 adjacent the channels. The pilot shafts are adapted to receive a nut with a plurality of flat surfaces and, similar to the head 42 of the bolt 41 discussed above, position the nut against the abrading wheel 24 in order to grind away the face of the nut adjacent the abrading wheel 24. For clarity purposes, only three pilot shafts, namely, pilot shaft 45, pilot shaft 46 and pilot shaft 47, are shown in the Figures adjacent channel 32, channel 35 and channel 37 respectively. However, it is to be understood that a pilot shaft may be provided with each channel, or some number fewer than all the channels, as desired.

Pilot shaft 45, shown positioned in channel 32 is an elongated cylindrical rod with a free end 48 and a rounded end 49. Pilot shaft 45 is pivotally mounted to the cover 8 by means of an L-shaped pivot arm 50 and a post 51. Post 51 is mounted on the top surface 30 of the cover 8 adjacent channel 32. One leg 52 of pivot arm 50 is pivotally mounted to pilot shaft 45 near rounded end 49 and forms a first pivot point. The other leg 53 of pivot arm 50 is pivotally mounted to post 51 and forms a second pivot point. Pilot shafts 46 and 47 are similar to pilot shaft 45, although of a different diameter, and are pivotally mounted to the cover 8 by means of pivot arm 55 and post 56 and pivot arm 58 and post 59, respectively.

As shown in the Figures, pilot shaft 45 extends beyond the opening 26 and over the abrading wheel 24. A nut 61 may be placed over free end 48 and onto pilot shaft 45 and held in place by means of a nut clip 62. The inner diameter of nut 61 is approximately the same size as the outer diameter of pilot shaft 45 in order to prevent movement of nut 61. Although nut 61 is shown having six flat faces, other nut configurations, such as square shaped or the like may be utilized. The nut clip 62 is basically an elongated, flat plate with support legs 63 dimpled or slotted onto pilot shaft 45, a pair of ears 64 which engage the nut 61 and a handle 65 for moving the nut clip 62 out of engagement with the nut 61. Although it is not shown in the drawings, each pilot shaft may be provided with an appropriate nut clip.

The nut 61 is brought into contact with the abrading wheel 24. Assuming the nut 61 is of sufficient size, pilot shaft 45 will initially not lay flat within channel 32 but will angle upward from the first pivot point at leg 52 toward the opening 26. Now if the abrading wheel 24 is rotated and downward force is applied to the nut 61 and pilot shaft 45, the surface of the nut 61 adjacent the abrading wheel 24 will be abraded and pilot shaft 45 will begin to pivot downwardly about the first pivot point. The nut 61 will continue to be abraded until pilot shaft 45 pivots downwardly and lays completely flat within channel 32 as shown in FIG. 2. This same process is then repeated for each face of the nut 61.

As with the abrading of a bolt discussed above, the nut 61 is reduced to a smaller size as determined by the distance between the bottom of each channel and the top of the abrading wheel 24. Likewise, the relationship between the channels and the abrading wheel 24 can be predetermined in order to grind nuts down from one standard size to another. Preferably, each pilot shaft is of a diameter which will enable the shaft to receive a nut which corresponds to the bolt which the channel is adapted to receive. Thereby, an entire bolt/nut combination can be reduced in size by a particular channel and associated pilot shaft. In addition, the pilot shaft may be used to position a worn nut with rounded corners against the abrading wheel 24 in order to square up the rounded corners.

As discussed above, each pilot shaft is mounted to the cover 8 by a pivot arm which provides for two pivot points, each perpendicular to the other. The first pivot point allows the free end of each pilot shaft to pivot in a plane extending along a radial line perpendicular to the surface of the cover 8. The second pivot point allows the entire pilot shaft to be pivoted out of its associated channel to a position parallel with the channel. Pilot shaft 47 is shown in such a position through movement about the second pivot point. Once a pilot shaft is moved completely out of channel, it may be pivoted about the first pivot point in order to move the free end of the pilot shaft away from the opening 26 and position such free end beyond the outer edge of the cover 8. Pilot shaft 46 is shown in such a position with its free end 66 oriented away from the opening 26.

The advantage of utilizing a polygon shaped opening, rather than a circular opening, is shown in FIG. 1 in connection with channel 37. Opening 26 includes a flat face 69 through which channel 37 extends. A space 70 is formed in between face 69 and abrading wheel 24. As is known in the art, bolts referred to as body bolts include an integral washer which is mounted loosely to the bolt near the bolt head but which cannot be physically removed from the bolt. The bolt 41 shown in FIG. 1 includes an integral washer 71. When bolt 41 is positioned in channel 37, appropriate provision must be made to keep the washer 71 out of contact with the abrading wheel 24 and to not otherwise interfere with the grinding process. If the opening 8 were circular it would need to be of a large enough diameter to provide sufficient spacing from the abrading wheel 24 along the entire diameter of the washer 71. By providing a flat face 69 adjacent channel 37, sufficient room is provided for the washer 71 without increasing the diameter of the opening. Hence, space 70 is adequate to accommodate washer 71 and prevent the washer 71 from interfering with the grinding process.

The grinding box of the present invention can be advantageously used to reduce nuts or bolt heads from one side to another or to flatten out the rounded corners of worn out nuts or bolt heads. In addition, the grinding box provides a holding fixture for positioning nuts and bolt heads against the abrading wheel 24 and holding them in place during the abrading process without burning the fingers of the operator. This invention can also be used to change the size of standard nuts or bolt heads from one standard size to a smaller standard size, such as, e.g., from ½" to 7/16". Ideally, this invention can be used to change the size of nuts or bolt heads from a standard size in one sizing system to a smaller standard size in another sizing system, such as from the metric system to the American system or vice versa. As shown by the examples below, it should be arranged to grind away as little material as possible from a bolt head or nut to convert the same to the next smaller size in another sizing system.

EXAMPLE 1

A #10 metric bolt head is to be ground down to the next closest American standard bolt head size. It is assumed in this example, as well as in the following examples, that the bolt heads and nuts are of the standard hex shape. The Japanese version of the #10 metric bolt head has a width across opposite faces of the head of 0.588". The closest American sized bolt head which is smaller than the #10 Japanese metric bolt head is a 9/16" bolt head which is approximately 0.562" in width. The difference in the two sizes is 0.026". To reduce the width of the #10 bolt head by 0.026", each face will have to be ground down by 0.013" or one-half of the difference in width. Accordingly, for modifying a #10 Japanese metric bolt head down to a 9/16" American sizing the relationship between the depth of the appropriate channel and the abrading wheel is set to remove 0.013" of material from each face of the bolt head.

EXAMPLE 2

The standard #10 metric bolt head has a width of approximately 0.663". The closest but smaller American sized bolt head is the ⅝" which is approximately 0.625" in width. The difference between the two widths is approximately 0.038", thereby requiring that 0.019" be removed from each face of the bolt head.

EXAMPLE 3

A #20 metric bolt head has a width of approximately 1.165" and the next closest but smaller American sized bolt head is $1\frac{1}{8}''$ which has a width of 1.125". The difference in the two widths is 0.040", thus requiring that 0.020" of material be removed from each face of the bolt head.

EXAMPLE 4

A #16 metric bolt head has a width of 0.938" while an American 15/16" bolt head has a width of 0.935". The difference between the two widths is 0.003". Therefore only 1 or 2 thousandths of an inch needs to be removed from each face of a #16 metric bolt head to convert it to a 15/16" American sized bolt head.

EXAMPLE 5

A #8 metric bolt head has a width of approximately 0.503" and a $\frac{1}{2}''$ American sized bolt head has a width of 0.500". The difference between he two is 0.003", thus requiring that 1 or 2 thousandths of an inch be removed from each face of a #8 bolt head to convert it to a $\frac{1}{2}''$ American sized bolt head.

EXAMPLE 6

A #12 metric bolt head is very close in size to a $\frac{3}{4}''$ American bolt head and will accept an American $\frac{3}{4}''$ wrench. Similarly a #7 metric bolt head is very close in size to a 7/16" American bolt head and will accept an American wrench of that size. Therefore a #7 or a #12 metric bolt head does not need to be ground down or converted in order for American wrenches to be usable therewith.

A nut associated with a bolt is generally the same size as the bolt head. Therefore, the nuts for the bolts discussed in the examples above would be ground down by an amount identical to that by which the bolt heads are ground down.

A grinding box may be provided with a plurality of channels and associated pivotally mounted nut pilot shafts wherein a predetermined spacing exists between the depth of the channel and the top of the abrading wheel in order to grind a bolt head or nut from one, known standard size to another. The channels and pilot shafts could be identified with the bolt size it will accept and the size the bolt will be converted to. For example, one channel may be marked #10 standard metric and $\frac{5}{8}''$ American. This would mean that the channel will accept a #10 standard metric bolt head and, by pressing the bolt head against the grinding wheel and abrading each face thereof to an extent determined by the depth of the channel, the bolt head will be converted to a $\frac{5}{8}''$ American size. Placing the nut for the #10 standard metric bolt head on the associated pilot shaft and, accordingly, grinding down the nut will convert it to a $\frac{5}{8}''$ American size.

Similarly, the grinding box could be provided to convert American sized bolts and nuts to metric sizing if desired.

Having, therefore, described the preferred embodiments of my invention, it is to be understood that it may be otherwise embodied within the scope of the appended claims.

I claim:

1. Apparatus for grinding bolt heads and nuts, said bolt heads and nuts each having a plurality of faces, said apparatus comprising:

(a) a housing, including a base, a sidewall and a cover, said cover being a flat plate having a top surface;

(b) abrading means disposed within the housing and beneath the cover, said abrading means being a power driven abrading wheel having a top surface;

(c) an opening through the cover providing access to the abrading wheel, said abrading wheel being adjacent the opening and spaced below the top surface of the cover, and (d) bolt positioning means for positioning a bolt head against the abrading wheel and nut positioning means for positioning a nut against the abrading wheel such that the faces of the bolt heads and nuts are abraded and the bolt heads and nuts are reduced to a predetermined smaller size, said bolt positioning means being one or more channels in the cover which extend outwardly from the opening along the top surface of the cover, each of the channels having a bottom and being adapted to receive a threaded portion of a bolt of a particular size and position the corresponding bolt head against the top surface of the abrading wheel, whereby the bolt head is reduced to a smaller size as determined by the spacing between the bottom of the channel and the top surface of the abrading wheel, and said nut positioning means being a nut pilot shaft pivotally mounted to the top surface of the cover adjacent each channel and having means for positioning each nut pilot shaft within said adjacent channel, wherein the nut has a central opening through which the nut pilot shaft enters, said nut surrounding the nut pilot shaft, each nut pilot shaft having a size which will accept a nut corresponding to the size of the bolt which the adjacent channel is adapted to receive, and each nut pilot shaft adapted to be positioned within said adjacent channel and position the nut against the top surface of the abrading wheel, whereby the nut is reduced to a smaller size as determined by the spacing between the bottom of the channel and the top surface of the abrading wheel.

2. The apparatus of claim 1 further including a nut clip on each pilot shaft to securely hold in place a nut positioned thereon.

3. The apparatus of claim 1 wherein the opening is formed in the shape of a polygon and one channel extends outwardly from each face of said polygon.

4. The apparatus of claim 3 wherein each channel extends outwardly from the opening to an adjacent outer edge of the cover.

5. The apparatus of claim 4 wherein the cover is a circular plate, the opening passes through the center of the cover, and the channels extend radially outward.

6. The apparatus of claim 1 wherein each channel is of a different depth and each pilot shaft is of a different diameter, such that nuts and bolts of varying diameter may be positioned against the abrading wheel.

7. The apparatus of claim 6 wherein each channel and each pilot shaft are provided of a particular size to accommodate bolts and nuts of one standard size and whereby the bolt heads and nuts are reduced to a smaller standard size.

8. The apparatus of claim 6 wherein each channel and each pilot shaft are provided of a particular size to accommodate bolts and nuts of a metric standard size and whereby the bolt heads and nuts are reduced to an American standard size.

* * * * *